US009429097B2

(12) United States Patent
Pursifull

(10) Patent No.: US 9,429,097 B2
(45) Date of Patent: Aug. 30, 2016

(54) DIRECT INJECTION PUMP CONTROL

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 90 days.

(21) Appl. No.: 14/560,497

(22) Filed: Dec. 4, 2014

(65) Prior Publication Data

US 2016/0160790 A1 Jun. 9, 2016

(51) Int. Cl.

| | |
|---|---|
| ***F02M 59/46*** | (2006.01) |
| ***F02D 41/30*** | (2006.01) |
| ***F02D 41/38*** | (2006.01) |
| ***F02D 41/26*** | (2006.01) |
| ***F02D 1/02*** | (2006.01) |
| ***F02M 59/02*** | (2006.01) |

(52) U.S. Cl.

CPC ..... *F02D 41/3082* (2013.01); *F02D 1/02* (2013.01); *F02D 41/26* (2013.01); *F02D 41/38* (2013.01); *F02M 59/027* (2013.01); *F02M 59/466* (2013.01); *F02D 2041/389* (2013.01)

(58) Field of Classification Search

CPC .... F02D 41/3082; F02D 41/38; F02D 41/26; F02D 2041/389; F02D 1/02; F02M 59/466; F02M 59/027; F02M 51/04; F02M 57/027; F02M 37/08

USPC ..... 123/457, 459, 499

See application file for complete search history.

(56) References Cited

U.S. PATENT DOCUMENTS

| | | | | |
|---|---|---|---|---|
| 8,402,952 | B2 | 3/2013 | Haaf et al. | |
| 8,776,764 | B2 | 7/2014 | Basmaji et al. | |
| 2009/0090331 | A1 | 4/2009 | Pursifull | |
| 2014/0230794 | A1 | 8/2014 | Surnilla et al. | |
| 2015/0354491 | A1* | 12/2015 | Ulrey | F02M 63/0001 123/294 |

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.

Pursifull, Ross D. et al., "High Pressure Fuel Pump Control for Idle Tick Reduction," U.S. Appl. No. 14/042,971, filed Oct. 1, 2013, 34 pages.

Surnilla, Gopichandra et al., "Adaptive Learning of Duty Cycle for a High Pressure Fuel Pump," U.S. Appl. No. 14/099,615, filed Dec. 6, 2013, 44 pages.

(Continued)

*Primary Examiner* — Hai Huynh

(74) *Attorney, Agent, or Firm* — Julia Voutyras; Alleman Hall McCoy Russell & Tuttle LLP

(57) ABSTRACT

Methods are provided for controlling a solenoid spill valve of a direct injection fuel pump, wherein the solenoid spill valve is energized and de-energized according to certain conditions. An example control strategy is provided for operating the direct injection fuel pump when fuel vapor is detected at an inlet of the direct injection fuel pump. To ensure pump effectiveness during the presence of fuel vapor, the solenoid spill valve may be maintained energized for a minimum angular duration past a top-dead-center position of a piston in the direct injection fuel pump.

20 Claims, 7 Drawing Sheets

(56) References Cited

OTHER PUBLICATIONS

Zhang, Hao et al., "Methods for Correcting Spill Valve Timing Error of a High Pressure Pump," U.S. Appl. No. 14/189,926, filed Feb. 25, 2014, 51 pages.

Pursifull, Ross D. et al., "Methods for Determining Fuel Bulk Modulus in a High-Pressure Pump," U.S. Appl. No. 14/189,946, filed Feb. 25, 2014, 52 pages.

Pursifull, Ross D. et al., "Direct Injection Pump Control for Low Fuel Pumping Volumes," U.S. Appl. No. 14/284,220, filed May 21, 2014, 40 pages.

Ulrey, Joseph N. et al., "Current Pulsing Control Methods for Lift Fuel Pumps," U.S. Appl. No. 14/444,739, filed Jul. 28, 2014, 48 pages.

Pursifull, Ross D., "Method and System for Supplying Liquefied Petroleum Gas to a Direct Fuel Injected Engine," U.S. Appl. No. 14/532,756, filed Nov. 4, 2014, 39 pages.

Ulrey, Joseph N. et al., "Optimizing Intermittent Fuel Pump Control," U.S. Appl. No. 14/558,363, filed Dec. 2, 2014, 44 pages.

* cited by examiner

DIRECT INJECTION PUMP CONTROL

FIELD

The present application relates generally to control schemes for a direct injection fuel pump in an internal combustion engine in response to fuel vapor ingestion.

SUMMARY/BACKGROUND

Some vehicle engine systems utilize gasoline direct injection (GDI) to increase power efficiency and range over which the fuel can be delivered to the cylinder. GDI fuel injectors may demand fuel at higher pressure for direct injection to create enhanced atomization providing more efficient combustion. In one example, a GDI system can utilize an electrically driven lower pressure pump (also termed a fuel lift pump) and a mechanically driven higher pressure pump (also termed a direct injection fuel pump) arranged respectively in series between the fuel tank and the fuel injectors along a fuel passage. In many GDI applications the higher pressure fuel pump may be used to increase the pressure of fuel delivered to the fuel injectors. The higher pressure fuel pump may include a solenoid actuated "spill valve" (SV) or fuel volume regulator (FVR) that may be actuated to control flow of fuel into the higher pressure fuel pump.

Various control strategies exist for operating the higher and lower pressure pumps to ensure efficient fuel system and engine operation. One strategy for reducing consumption of electrical energy in the higher pressure pump may include energizing the solenoid actuated spill valve for shorter durations. For example, a normally-open solenoid actuated spill valve may be energized to close at a certain time during a compression stroke of the fuel pump based on a desired fuel volume output. The solenoid actuated spill valve may then be de-energized when pressure within a compression chamber of the higher pressure fuel pump increases sufficiently. Herein, the increase in pressure within the compression chamber may be adequate to maintain the spill valve in its closed position even though the solenoid is de-energized. As such, the solenoid actuated spill valve may be de-energized at an earlier time, e.g. before the compression stroke is completed, enabling a reduction in energy consumption and solenoid heating.

However, the inventors herein have identified a potential issue with the above strategy. As an example, the strategy of de-energizing the solenoid actuated spill valve at an earlier time may be ineffective when fuel vapor is present at an inlet of the direct injection fuel pump. If fuel vapor is at least partially ingested during pumping, pressure within the compression chamber of the direct injection fuel pump may not be sufficient to hold the spill valve closed after the solenoid actuated spill valve is de-energized. Accordingly, de-energizing the solenoid at the earlier time may result in a decrease in compression pressure due to fuel flow out of the compression chamber via the spill valve. Pump efficacy may be reduced and the desired output of fuel volume, at a desired fuel pressure may not be achieved. The inventors herein have recognized that control strategies are needed that specifically address situations when fuel vapor is present at the inlet of the higher pressure direct injection fuel pump.

Thus in one example, the above issue may be at least partially addressed by a method, comprising energizing a solenoid spill valve of a direct injection fuel pump for an angle past top center of a piston in the direct injection fuel pump. The angle may be a non-zero angle and may result in the valve being energized longer than a minimum angular duration past top center of a position of a piston in the direct injection fuel pump in response to fuel vapor detected at an inlet of the direct injection fuel pump. In this way, pump efficiency may be maintained during conditions when fuel vapor is present at the inlet of the higher pressure (or direct injection) fuel pump.

For example, a fuel system in a GDI engine may include a lift pump positioned upstream of a direct injection fuel pump. A fuel composition sensor may be positioned downstream of the lift pump and upstream of the direct injection fuel pump. A volume of fuel pumped by the direct injection fuel pump may be controlled by an angular duration of energizing a solenoid actuated spill valve in the direct injection fuel pump. During conditions when fuel vapor is not detected at an inlet of the direct injection fuel pump, the solenoid actuated spill valve may be energized within a compression stroke for a shorter angular duration. Herein, the solenoid actuated spill valve may be de-energized prior to a completion of the compression stroke in the direct injection fuel pump. Fuel vapor may be detected based on fuel capacitance as measured by the fuel composition sensor. When fuel vapor is detected at the inlet of the direct injection fuel pump, the solenoid actuated spill valve may be energized for at least a minimum angular duration based on the position of a piston in the direct injection fuel pump. In another example, if fuel vapor is present, the solenoid actuated spill valve may be energized for longer than the minimum angular duration based on the position of the piston in the direct injection fuel pump. As such, the solenoid actuated spill valve may be energized at least until after the compression stroke is completed when fuel vapor is detected at the inlet of the direct injection fuel pump.

In this way, the solenoid actuated spill valve may be controlled differently based on presence of fuel vapor at the inlet of the direct injection fuel pump. By energizing the solenoid actuated spill valve for at least a minimum angular duration based on the position of the piston of the direct injection fuel pump, closure of the spill valve may be ensured throughout the compression stroke of the pump. Overall, fuel pump efficacy may be maintained to provide a commanded fuel volume at a desired fuel pressure to direct injectors.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
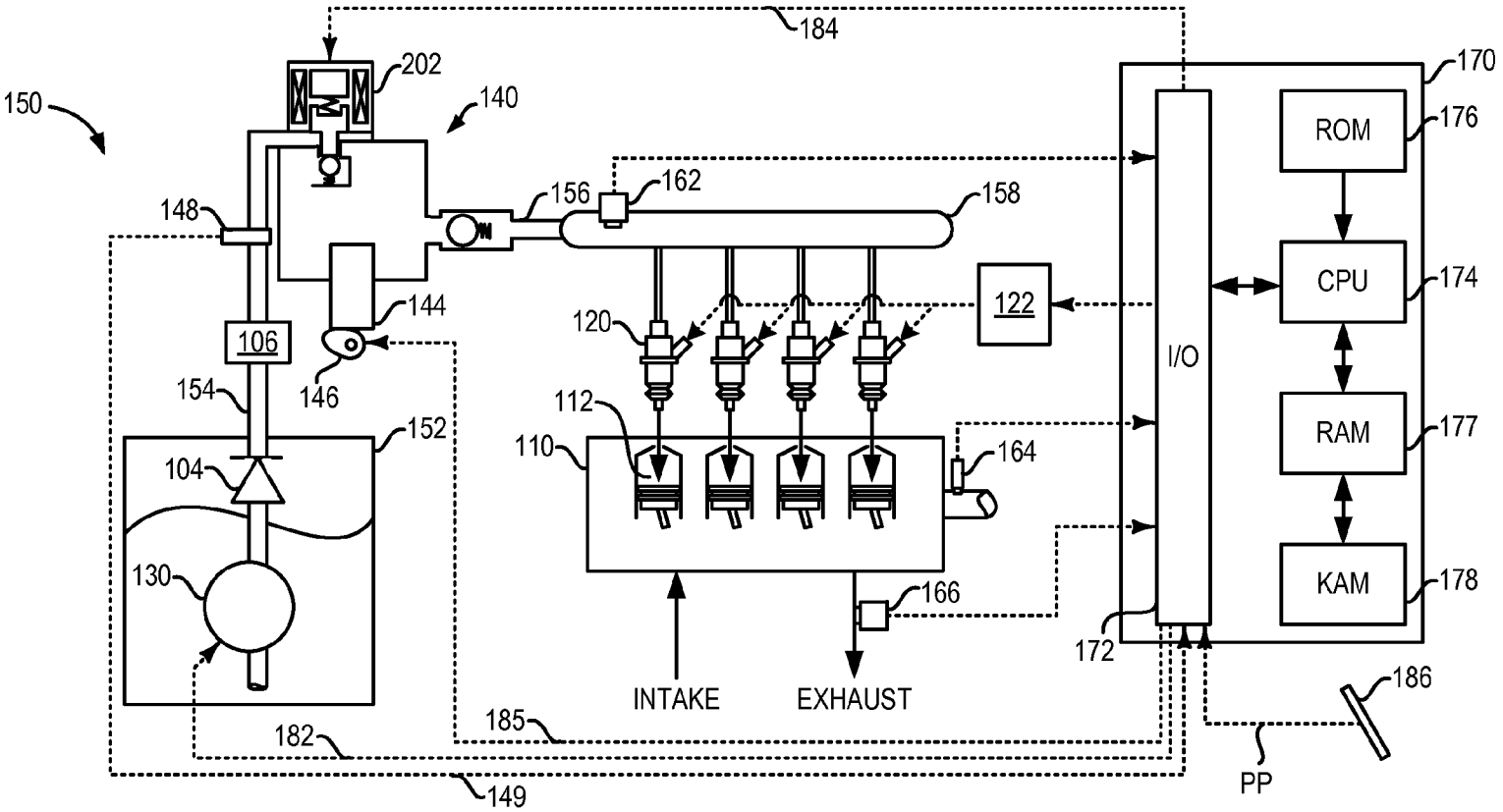
FIG. 1 depicts a schematic diagram of an example fuel system coupled to an engine.
Figure 3A:
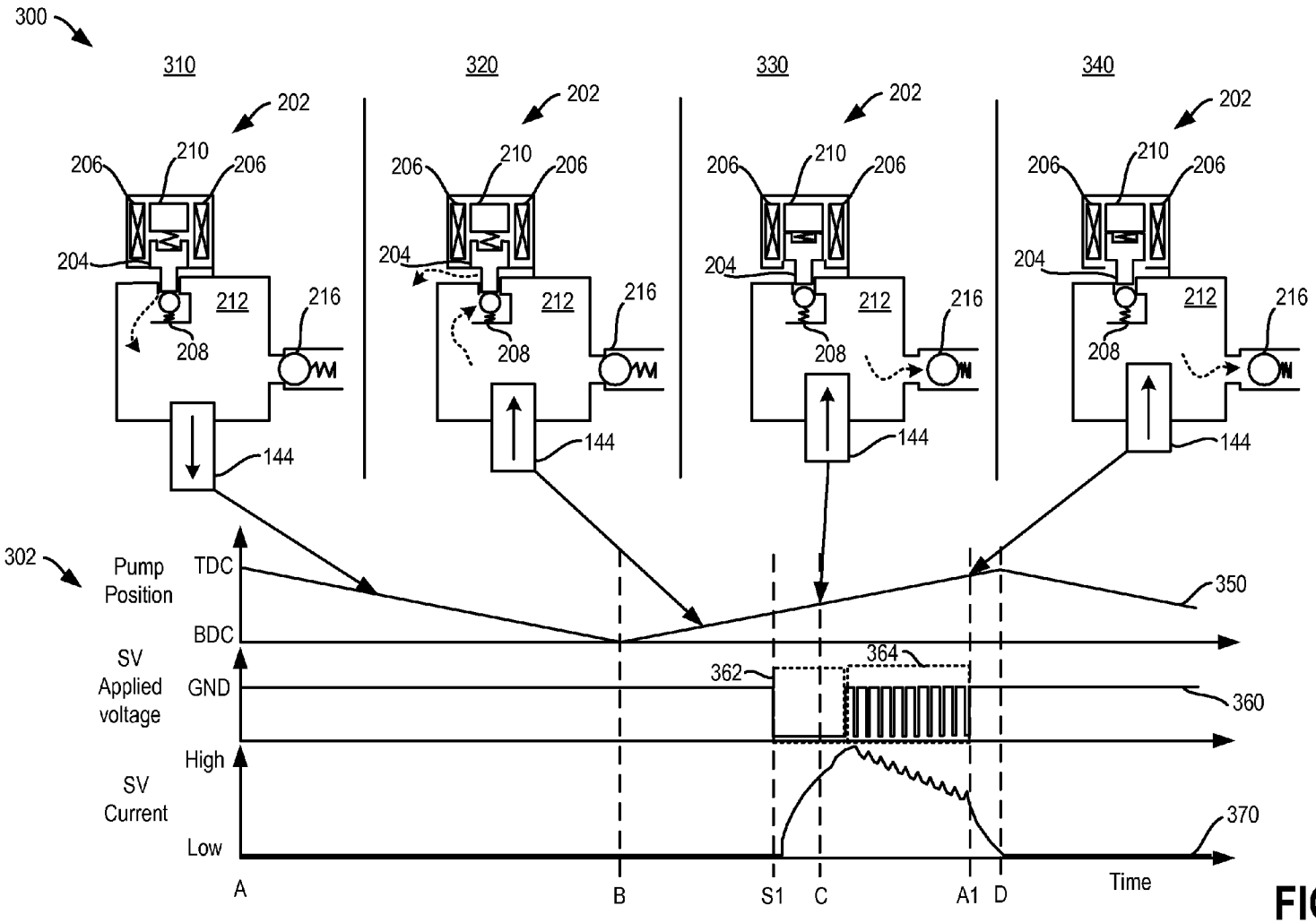
FIG. 3*a* shows an example first control strategy of the direct injection fuel pump of the fuel system of FIG. 1.
Figure 3B:
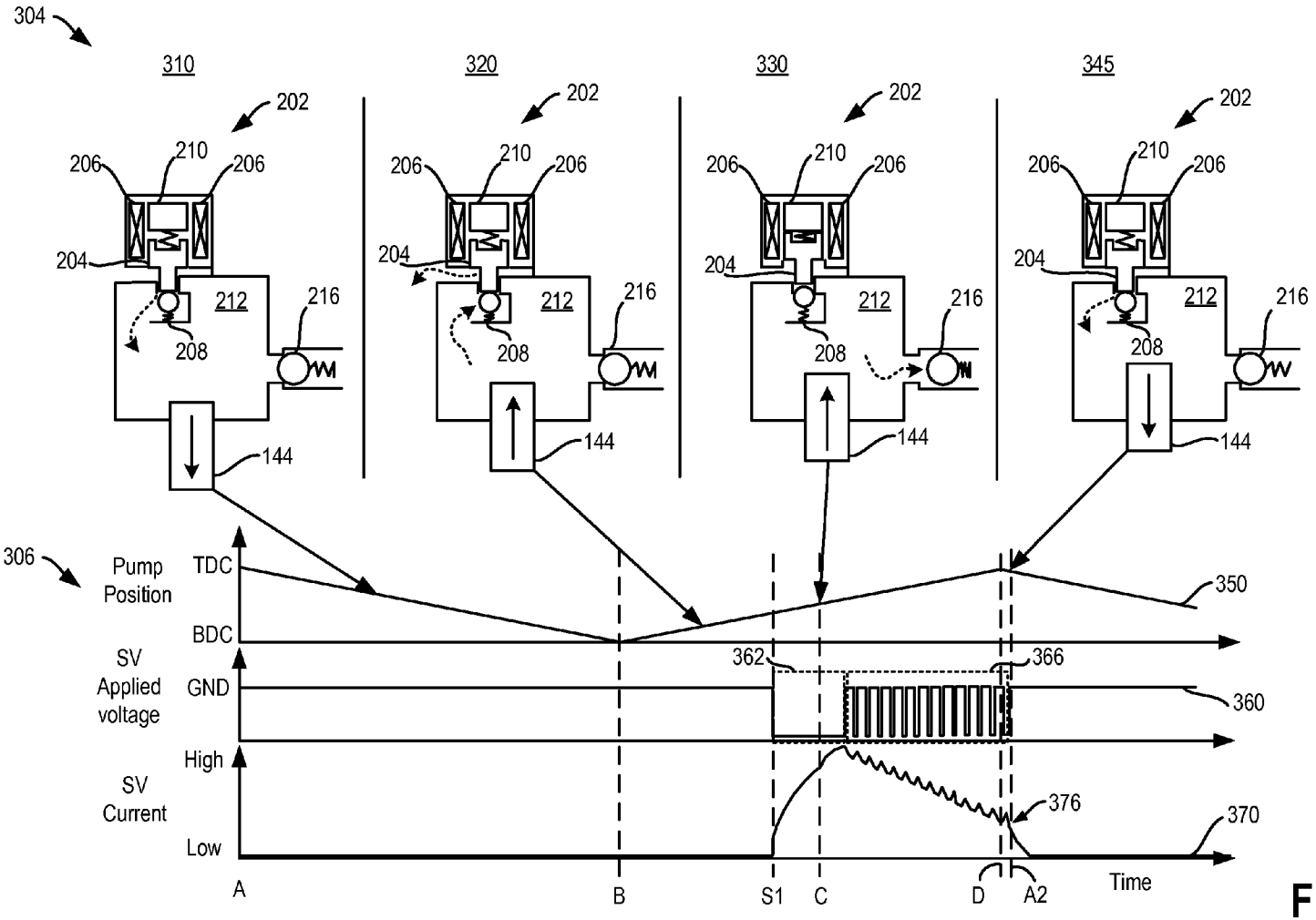
FIG. 3*b* portrays an example second control strategy, also termed hold-past-delivery strategy, of the direct injection fuel pump of the fuel system of FIG. 1 in accordance with the present disclosure.
Figure 4:
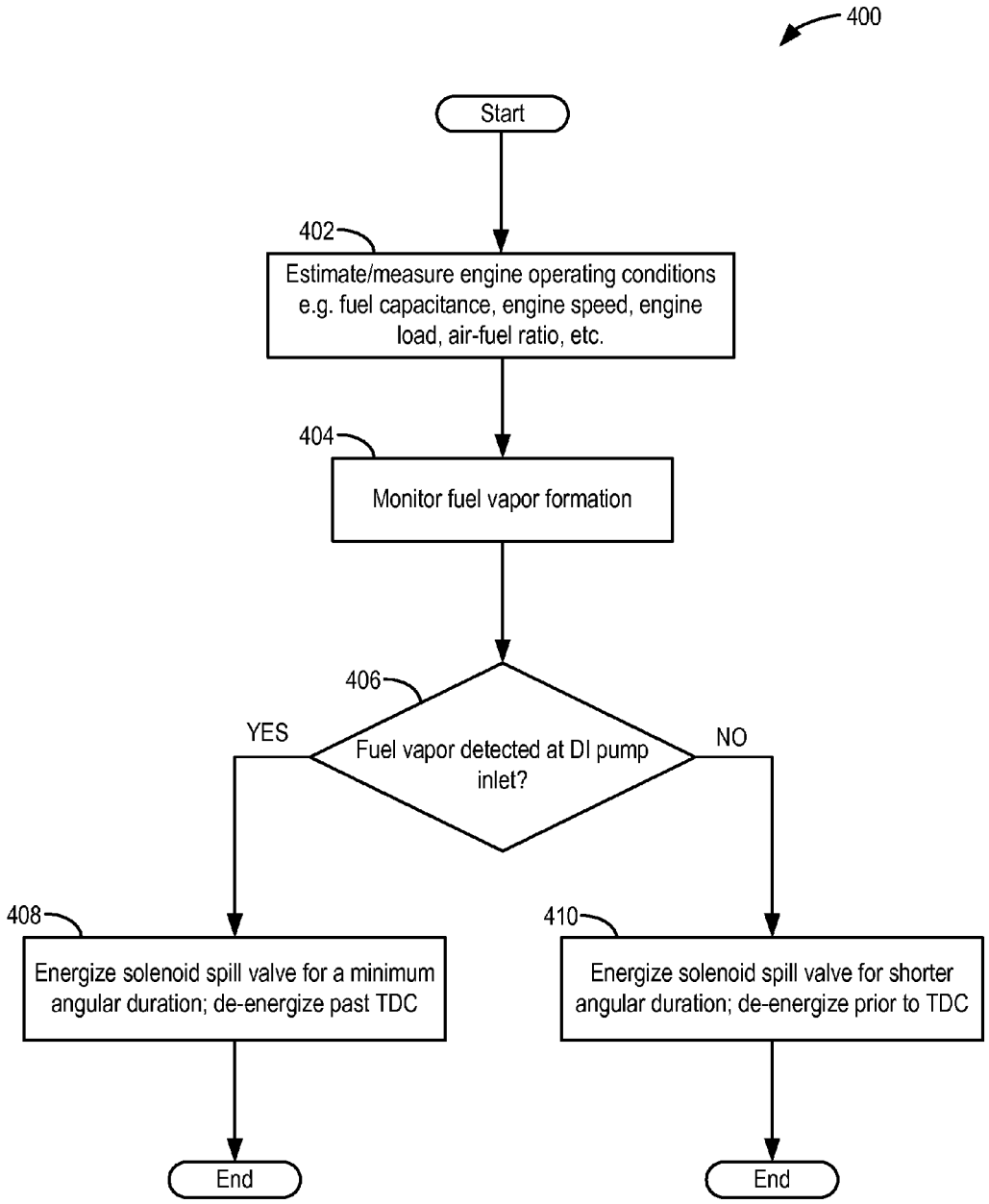
FIG. 4 presents a high level flow chart illustrating an implementation of the second control strategy based on detection of fuel vapor at the inlet of the direct injection fuel pump of the fuel system of FIG. 1.

The following detailed description relates to a direct injection fuel pump, its related fuel and engine systems, such as the example fuel and engine system depicted in FIG. 1. The direct injection fuel pump may include a solenoid actuated spill valve (FIG. 2) coupled fluidically at an inlet of a compression chamber within the direct injection fuel pump. A first control strategy for regulating fuel volume and pressure to the direct injection fuel rail and injectors via the direct injection fuel pump is shown in FIG. 3*a*. The first control strategy may enable reduced power consumption by the fuel system. A second control strategy for regulating fuel volume and pressure to the direct injection fuel rail and injectors via the direct injection fuel pump during conditions indicating presence of fuel vapor at the inlet of the direct injection fuel pump is shown in FIG. 3*b*. A controller in the engine may be configured to select either the first control strategy or the second control strategy based on detection of fuel vapor at the inlet of the direct injection fuel pump (FIG. 4). An example control of the solenoid actuated spill valve depicting the first and the second control strategies is presented in FIG. 5. The solenoid actuate spill valve may also be controlled with strategies distinct from the first and second control strategies (FIG. 6) based on other conditions.

Regarding terminology used throughout this detailed description, a higher-pressure fuel pump, or direct injection fuel pump, that provides pressurized fuel to direct injectors may be abbreviated as a DI or HP pump. Similarly, a lower-pressure pump (providing fuel pressure generally lower than that of the DI pump), or lift pump, that provides pressurized fuel from a fuel tank to the DI pump may be abbreviated as an LP pump. A solenoid actuated spill valve (SV), which may be electronically energized to close and de-energized to open (or vice versa), may also be referred to as a spill valve, a fuel volume regulator, magnetic solenoid valve, solenoid actuated check valve (SACV), and a digital inlet valve, among other names. Depending on when the spill valve is energized during operation of the DI pump, an amount of fuel may be trapped and compressed by the DI pump during a delivery stroke, wherein the amount of fuel may be referred to as fractional trapping volume if expressed as a fraction or decimal, fuel volume displacement, or pumped fuel mass, among other terms.

FIG. 1 shows a fuel system 150 including a direct injection fuel pump 140 coupled to an internal combustion engine 110. As one non-limiting example, engine 110 with fuel system 150 can be included as part of a propulsion system for a passenger vehicle. Engine 110 may be controlled at least partially by a control system including controller 170 and by input from a vehicle operator (not shown) via an input device 186. In this example, input device 186 includes an accelerator pedal and a pedal position sensor (not shown) for generating a proportional pedal position signal PP.

The internal combustion engine 110 may comprise multiple combustion chambers 112 (also termed cylinders 112). Fuel can be provided directly to the cylinders 112 via in-cylinder direct injectors 120. Thus, each cylinder 112 may receive fuel from a respective direct injector 120. As indicated schematically in FIG. 1, engine 110 can receive intake air and expel exhaust products of the combusted fuel. The engine 110 may include a suitable type of engine including a gasoline or diesel engine.

Fuel can be provided to the engine 110 via the direct injectors 120 by way of the fuel system indicated generally at 150. In this particular example, the fuel system 150 includes a fuel storage tank 152 for storing the fuel on-board the vehicle, a low-pressure fuel pump 130 (e.g., a fuel lift pump), the high-pressure fuel pump or direct injection (DI) pump 140, a fuel rail 158, and various fuel passages 154 and 156. In the example shown in FIG. 1, the fuel passage 154 carries fuel from the low-pressure fuel pump 130 to the DI pump 140, and the fuel passage 156 carries fuel from the DI pump 140 to the fuel rail 158. As such, fuel passage 154 may be a low-pressure passage (or a low-pressure fuel line) while fuel passage 156 may be a high-pressure passage. Fuel rail 158 may be a high pressure fuel rail fluidically coupling an outlet of the direct injection fuel pump 140 to a plurality of direct injectors 120.

Fuel rail 158 may distribute fuel to each of the plurality of direct injectors 120. Each of the plurality of direct injectors 120 may be positioned in a corresponding cylinder 112 of engine 110 such that during operation of direct injectors 120 fuel is injected directly into each corresponding cylinder 112. Alternatively (or in addition), engine 110 may include fuel injectors positioned at the intake port of each cylinder such that during operation of the fuel injectors fuel is injected in to the intake port of each cylinder. In the illustrated embodiment, engine 110 includes four cylinders. However, it will be appreciated that the engine may include a different number of cylinders without departing from the scope of this disclosure.

The low-pressure fuel pump 130 can be operated by controller 170, as indicated at 182, to provide fuel to DI pump 140 via fuel passage 154. The low-pressure fuel pump 130 can be configured as what may be referred to as a lift pump. As one example, low-pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to lift pump 130, the volumetric flow rate and/or pressure increase across the pump may be reduced. The volumetric flow rate and/or pressure increase across the pump may be increased by increasing the electrical power that is provided to the lift pump 130. As one example, the electrical power supplied to the low-pressure pump motor can be obtained from an alternator or other energy storage device on-board the vehicle (not shown), whereby the control system can control the electrical load that is used to power the low-pressure pump. Thus, by varying the voltage and/or current provided to the low-pressure fuel pump, the flow rate and pressure of the fuel provided to DI pump 140 and ultimately to the fuel rail 158 may be adjusted by the controller 170.

Low-pressure fuel pump 130 may be fluidically coupled to check valve 104 to facilitate fuel delivery and maintain fuel line pressure. In particular, check valve 104 includes a ball and spring mechanism that seats and seals at a specified pressure differential to deliver fuel downstream. In some embodiments, fuel system 150 may include a series of check valves fluidically coupled to low-pressure fuel pump 130 to further impede fuel from leaking back upstream of the valves. Check valve 104 is fluidically coupled to filter 106 which may remove small impurities contained in the fuel that could potentially damage engine components. Fuel may be delivered from filter 106 to high-pressure fuel pump (e.g., DI pump) 140. DI pump 140 may increase the pressure of fuel received from filter 106 from a first pressure level generated by low-pressure fuel pump 130 to a second pressure level higher than the first pressure level. DI pump 140 may deliver high pressure fuel to fuel rail 158 via fuel passage 156 (also termed fuel line 156). DI pump 140 will be discussed in further detail below with reference to FIG. 2. Operation of DI pump 140 may be adjusted based on operating conditions of the vehicle in order to provide more efficient operation of the fuel system and the engine. As such, methods for operating the higher-pressure DI pump 140 will be discussed in further detail below with reference to FIGS. 3-6.

The DI pump 140 can be controlled by the controller 170 to provide fuel to the fuel rail 158 via the fuel passage 156. As one non-limiting example, DI pump 140 may utilize a flow control valve, a solenoid actuated "spill valve" (SV) or fuel volume regulator (FVR), indicated at 202 to enable the control system to vary the effective pump volume of each pump stroke, as indicated at 184. SV 202 may be separate or part of (i.e., integrally formed with) DI pump 140. The DI pump 140 may be mechanically driven by the engine 110 in contrast to the motor driven low-pressure fuel pump or lift pump 130. A pump piston 144 of the DI pump 140 can receive a mechanical input from an engine crank shaft or cam shaft via a cam 146. In this manner, DI pump 140 can be operated according to the principle of a cam-driven single-cylinder pump. Furthermore, the angular position of cam 146 may be estimated or determined by a sensor (not shown) located near cam 146. The cam may communicate with controller 170 as shown via electronic connection 185. In particular, the sensor may measure an angle of cam 146 in degrees ranging from 0 to 360 degrees according to the circular motion of cam 146.

As depicted in FIG. 1, a fuel composition sensor 148 is disposed downstream of the lift pump 130 and upstream of the DI pump 140. The fuel composition sensor 148 may measure fuel composition and may operate based on fuel capacitance, or the number of moles of a dielectric fluid within its sensing volume. For example, an amount of ethanol (e.g., liquid ethanol) in the fuel may be determined (e.g., when a fuel alcohol blend is utilized) based on the capacitance of the fuel. The fuel composition sensor 148 may communicate to controller 170 via connection 149 and may be used to determine a level of vaporization of the fuel, as fuel vapor has a smaller number of moles within the sensing volume than liquid fuel. As such, fuel vaporization may be indicated when the fuel capacitance drops off. The fuel composition sensor 148 may be utilized, in one example embodiment, to determine the level of fuel vaporization of the fuel such that the controller 170 may adjust the lift pump pressure in order to reduce fuel vaporization within the fuel lift pump 130. Further, the controller 170 may also modify operation of the DI pump in response to the indication of fuel vapor at the DI fuel pump inlet. This operation will be further described in reference to FIGS. 3-5.

Further still, in some examples, the DI pump 140 may be operated as the fuel composition sensor 148 to determine the level of fuel vaporization. For example, a piston-cylinder assembly of the DI pump 140 forms a fluid-filled capacitor. As such, the piston-cylinder assembly allows the DI pump 140 to be the capacitive element in the fuel composition sensor. In some examples, the piston-cylinder assembly of the direct injection fuel pump 140 may be the hottest point in the system, such that fuel vapor forms there first. In such an example, the DI pump 140 may be utilized as the sensor for detecting fuel vaporization, as fuel vaporization may occur at the piston-cylinder assembly before it occurs anywhere else in the system.

As shown in FIG. 1, the fuel rail 158 includes a fuel rail pressure sensor 162 for providing an indication of fuel rail pressure to the controller 170. An engine speed sensor 164 can be used to provide an indication of engine speed to the controller 170. The indication of engine speed can be used to identify the speed of DI pump 140, since the DI pump 140 is mechanically driven by the engine 110, for example, via the crankshaft or camshaft. An exhaust gas sensor 166 can be used to provide an indication of exhaust gas composition to the controller 170. As one example, the gas sensor 166 may include a universal exhaust gas sensor (UEGO). The exhaust gas sensor 166 can provide feedback to the controller to adjust the amount of fuel that is delivered to the engine via the direct injectors 120. In this way, the controller 170 can control the air/fuel ratio delivered to the engine to a prescribed set-point.

In addition to the above, controller 170 may receive other engine/exhaust parameter signals from other engine sensors such as from sensors estimating engine coolant temperature, engine speed, throttle position, absolute manifold pressure, emission control device temperature, etc. Further still, controller 170 may provide feedback control based on signals received from fuel composition sensor 148, fuel rail pressure sensor 162, and engine speed sensor 164, among others. For example, controller 170 may send signals to adjust a current level, current ramp rate, pulse width of a solenoid valve (SV) 202 of DI pump 140, and the like via connection 184 to adjust operation of DI pump 140. Also, controller 170 may send signals to adjust a fuel pressure set-point of the fuel pressure regulator and/or a fuel injection amount and/or timing based on signals from fuel composition sensor 148, fuel rail pressure sensor 162, engine speed sensor 164, and the like.

The controller 170 can individually actuate each of the direct injectors 120 via a fuel injection driver 122. The controller 170, the driver 122, and other suitable engine system controllers can comprise a control system. While the driver 122 is shown external to the controller 170, in other examples, the controller 170 can include the driver 122 or can be configured to provide the functionality of the driver 122. The controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. The storage medium ROM 176 can be programmed with computer readable data representing non-transitory instructions executable by the processor 174 for performing the methods described below as well as other variants that are anticipated but not specifically listed.

As shown, fuel system 150 is a returnless fuel system, and may be a mechanical returnless fuel system (MRFS) or an electronic returnless fuel system (ERFS). In the case of an MRFS, the fuel rail pressure may be controlled via a pressure regulator (not shown) positioned at the fuel storage tank 152. In an ERFS, fuel rail pressure sensor 162 mounted at the fuel rail 158 may measure the fuel rail pressure relative to the manifold pressure. The signal from the fuel rail pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, fuel system 150 may include a return line whereby excess fuel from the engine is returned via a fuel pressure regulator to the fuel tank via a return line. A fuel pressure regulator may be coupled in line with a return line to regulate fuel delivered to fuel rail 158 at a set-point pressure. To regulate the fuel pressure at the set-point, the fuel pressure regulator may return excess fuel to fuel storage tank 152 via the return line. It will be appreciated that operation of fuel pressure regulator may be adjusted to change the fuel pressure set-point to accommodate operating conditions.

Figure 2:
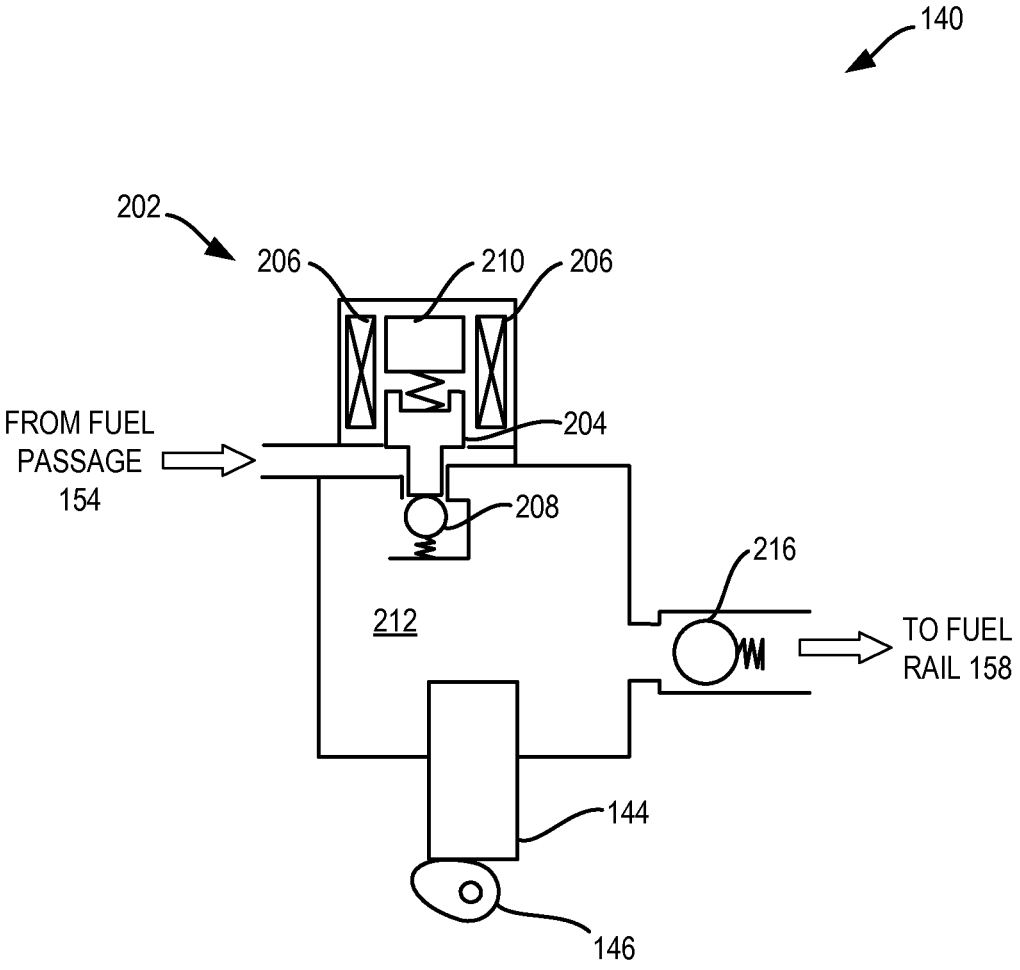
FIG. 2 is a schematic diagram of a solenoid actuated spill valve coupled to a direct injection fuel pump of the fuel system of FIG. 1.

FIG. 2 shows an example of a DI pump 140. DI pump 140 delivers fuel to the engine via intake and delivery pump strokes of fuel supplied to fuel rail 158. The DI fuel pump 140 includes an outlet fluidically coupled to direct injection fuel rail 158. As seen, the DI pump includes pump piston 144 constrained to move linearly to intake, compress, and eject fuel. Furthermore, solenoid spill valve 202 (also termed SV 202) is fluidically coupled to an inlet of the direct injection fuel pump. Further still, lift pump 130 may be fluidically coupled to solenoid spill valve 202 via fuel passage 154, as shown in FIG. 1. Controller 170 may include computer readable instructions stored in non-transitory memory for executing various control schemes.

SV 202 may be a normally-open solenoid actuated spill valve wherein when SV 202 is not energized, inlet check valve 208 is held open and no pumping can occur. When energized, the SV 202 assumes a position such that inlet check valve 208 functions as a check valve. Depending on the timing of the energizing of SV 202, a given amount of pump displacement may be used to push a given fuel volume into the fuel rail. Thus, SV 202 functions as a fuel volume regulator. As such, the angular timing of energizing the solenoid may control the effective pump displacement. Furthermore, the solenoid current application may influence the pump noise.

SV 202, also illustrated in FIG. 1, includes solenoids 206 that may be electrically energized by controller 170. By energizing solenoids 206, plunger 204 may be drawn towards the solenoids 206 away from the inlet check valve 208 until plunger 204 contacts plate 210. Inlet check valve 208 may now function as a check valve that allows fuel to flow into pressure chamber 212 (or compression chamber 212) but blocks fuel flow out of pressure chamber 212. When SV 202 is energized, check valve 208 is allowed to function as an inlet check valve. When not energized, it is forced open and allows fluid to travel either direction through itself. As such, the pump may maintain the pumping function while functioning as the inlet check valve. Further, controller 170 may send a pump signal that may be modulated to adjust the operating state (e.g., open or close) of SV 202. Modulation of the pump signal may include adjusting a current level, current ramp rate, a pulse-width, a duty cycle, or another modulation parameter. Further still, plunger 204 may be biased such that, upon de-energizing solenoids 206, plunger 204 may move away from the solenoids 206 towards inlet check valve 208. As such, inlet check valve 208 may now be disabled and SV 202 may be placed in an open state allowing fuel to flow into, and out of, pressure chamber 212 of DI pump 140. As will be described in reference to FIG. 3*a*, SV 202 may be held in a closed state even though solenoids 206 are de-energized when pressure within pressure chamber 212 of the DI pump 140 is higher. Operation of pump piston 144 of DI pump 140 may increase the pressure of fuel in pressure chamber 212 when SV 202 is closed. Upon reaching a pressure set-point, fuel may flow through outlet valve 216 to fuel rail 158.

As presented above, direct injection or high-pressure fuel pumps may be piston pumps that are controlled to compress a fraction of their full displacement by varying closing timing of the solenoid spill valve. As such, a full range of pumping volume fractions may be provided to the direct injection fuel rail and direct injectors depending on when the spill valve is energized and de-energized. For example, 50% pumping volume (or a 50% duty cycle) may be provided by energizing solenoids 206 of SV 202 at about midway through a compression stroke in the DI fuel pump. Thus, about 50% of the DI fuel pump volume may be pressurized and pumped to fuel rail 158. When fuel vaporization is nominal and fuel vapor is not detected at the DI pump inlet, solenoids 206 of the spill valve 202 may be de-energized earlier, as in before pump piston 144 attains top-dead-center (TDC) in the compression stroke. Top-dead-center position may refer to the pump piston reaching a maximum height in the pump compression chamber (minimum compression chamber volume). Herein, even though SV 202 is de-energized, the higher pressure within the compression chamber 212 (as TDC position is approached by pump piston 144) may retain inlet check valve 208 in its closed position such that fuel may not flow out of compression chamber 212 towards fuel passage 154. Further still, since pressure within the pressure chamber 212 is higher, fuel may not enter the compression chamber 212 through inlet check valve 208 even when solenoids 206 are de-energized. By de-energizing solenoids 206 at an earlier time, electrical power consumption and heating of the solenoids may be reduced while maintaining pump efficacy.

An example system may comprise an engine including a cylinder, a direct fuel injector coupled to the cylinder, a direct injection fuel pump including a piston, a compression chamber, and a cam for driving the piston, a high pressure fuel rail (such as fuel rail 158 of FIG. 1, fluidically coupled to each of the direct fuel injector and an outlet of the direct injection fuel pump, a solenoid spill valve fluidically coupled to an inlet of the direct injection fuel pump, a lift pump fluidically coupled to the solenoid spill valve via a low pressure fuel line, a fuel composition sensor coupled to the low pressure fuel line downstream of the lift pump and upstream of the solenoid spill valve, and a controller with computer readable instructions stored in non-transitory memory for controlling operation of the direct injection fuel pump.

FIG. 3*a* shows an example operating sequence of DI pump 140 depicting a first control strategy 300 wherein the solenoid actuated spill valve is de-energized prior to TDC. In particular, first control strategy 300 shows the operation of DI pump 140 during intake and delivery strokes (also termed compression strokes) of fuel supplied to fuel rail 158. Each of the illustrated moments (e.g., 310, 320, 330, and 340) of first control strategy 300 show events or changes in the operating state of DI pump 140. Dashed arrows within the illustrated moments indicate fuel flow. Signal timing chart 302 shows a pump position 350, SV applied voltage signal 360 for controlling fuel intake into the DI pump 140, and solenoid current 370 resulting from the applied voltage signal 360. Time is plotted along x-axis wherein time increases from left to right of the x-axis.

At time A, the DI pump may initiate an intake stroke as pump piston 144 positioned at top-dead-center (TDC) is pushed outwards from pressure chamber 212. SV applied voltage (or pull-in applied voltage) 360 is at 0% duty cycle (GND) while SV 202 is open, allowing fuel to enter the pressure chamber 212. Moment 310 illustrates a moment during the intake stroke wherein SV 202 is de-energized. Next, at time B, pump piston 144 reaches bottom-dead-center (BDC) position and is retracted into pressure chamber 212 as a compression stroke begins.

The top-dead-center position of the pump piston 144 includes when the piston 144 is at a top position to consume all of a displacement volume of compression chamber 212 of the DI fuel pump 140. That is, the displacement volume of the compression chamber is at a minimum when the position of the piston is at TDC. Similarly, the bottom-dead-center position of pump piston 144 includes when the pump piston 144 is at a bottom position to maximize the displacement volume of compression chamber 212. Moment 320 depicts a point towards the beginning of the compression stroke when SV 202 remains de-energized and fuel may flow into, and out of, pressure chamber 212 as shown by dashed arrows. As shown in moment 320, some fuel in pressure chamber 212 may be pushed out past inlet check valve 208 before it fully closes as pump piston 144 travels towards TDC.

In preparation for fuel delivery, a pull-in impulse 362 of the SV applied voltage 360 is initiated at time S1 to close SV 202 (as in, allow inlet check valve 208 to function as a check valve). In response to the pull-in impulse 362, the solenoid current 370 begins to increase. Accordingly, SV 202 may be energized at time S1. During the pull-in impulse 362, the SV applied voltage 360 signal may be 100% duty cycle, however, the SV applied voltage 360 signal may also be less than 100% duty cycle. Furthermore, the duration of the pull-in impulse 362, the duty cycle impulse level, and the duty cycle impulse profile (e.g., square profile, ramp profile, and the like) may be adjusted corresponding to the SV, fuel system, engine operating conditions, and the like, in order to reduce pull-in current and duration, thereby reducing noise, vibration, and harshness (NVH) during fuel injection. By controlling the pull-in current level, pull-in current duration or the pull-in current profile, the interaction between the solenoid armature and plunger 204 may be controlled.

At time C (and as shown in moment 330), SV 202 may continue to be energized and may now be fully closed in response to the SV applied voltage pull-in impulse and the increasing solenoid current 370. Accordingly, inlet check valve 208 now functions as a check valve to block fuel flow out of pressure chamber 212. It will be noted that time C occurs about midway during the compression stroke (between time B and time D) and in the depicted example, about 50% of fuel may be trapped within the pump to be pressurized and delivered to fuel rail 158. Furthermore, at time C, outlet valve 216 is opened, allowing for fuel flow from the pressure chamber 212 into fuel rail 158.

Sometime after time C, the SV pull-in applied voltage 360 may be set to a holding signal 364 of approximately 25% duty cycle to command a holding solenoid current 370 in order to maintain the inlet check valve 208 in the closed position during fuel delivery. At the end of the holding current duty cycle, which is coincident with time A1, SV applied voltage is reduced to ground (GND), lowering the solenoid current 370. As such, solenoids 206 of SV 202 may be de-energized at time A1, prior to pump piston 144 attaining TDC position. Even though solenoids 206 of SV 202 may be de-energized at A1, inlet check valve 208 may remain closed due to the increased pressure within pressure chamber 212 until the beginning of a subsequent intake stroke. Herein, fuel flow from fuel passage 154 into pressure chamber 212 may not occur and fuel flow from pressure chamber 212 towards fuel passage 154 may also be impeded. If pressure within compression chamber 212 is higher, deactivation plunger spring force of inlet check valve 208 may not overcome the compression pressure. However, fuel may continue to flow from pressure chamber 212 towards fuel rail 158 via outlet valve 216 as shown in moment 340. It will be noted that the duty cycle level and duration of holding signal 364 may be adjusted in order to initiate specific outcomes, such as reducing solenoid current and NVH.

Upon completion of the delivery stroke at time D (piston at TDC position), as pump piston 144 begins a subsequent intake stroke, inlet check valve 208 may open as pressure within pressure chamber 212 decreases. Therefore, inlet check valve 208 of spill valve 202 may be held in the closed position from time C until TDC is reached. As such, when trapping amounts within the compression chamber are substantial, compression pressure within the pressure chamber of the DI pump may hold inlet check valve 208 closed until TDC position of the piston is achieved even though solenoids 206 may be de-energized at an earlier time e.g. between time C and time D.

It will be appreciated that time C may occur anywhere between time B, when pump piston 144 reaches the BDC position, and time D, when pump piston 144 reaches the TDC position to complete a cycle of the pump and to start the next cycle (consisting of intake and compression strokes). Particularly, SV 202 and consequently, inlet check valve 208 may fully close at any moment between the BDC and TDC positions of pump piston 144, thereby controlling the amount of fuel that is pumped by DI pump 140. As previously mentioned, the amount of fuel may be referred to as fractional trapping volume or fractional pumped displacement, which may be expressed as a decimal or percentage. For example, the trapping volume fraction is 100% when the solenoid spill valve is energized to a closed position coincident with the beginning of a compression stroke of the piston of the direct injection fuel pump.

It will be noted that for larger trapping volumes, the pressure present in compression chamber 212 during the delivery or compression stroke (when pump piston 144 travels from BDC to TDC) may hold the SV 202 closed to TDC by default after de-energizing SV 202 e.g. at time A1. However, for situations when fuel vapor is present at the inlet of the DI pump, and is at least partially ingested into the DI pump, the ability of the DI pump to build sufficient pressure within pressure chamber 212 may be compromised. In such cases, de-energizing SV 202 earlier than TDC (as at A1 in FIG. 3*a*) may render the DI pump ineffective. For example, without sufficient pressure build-up within pressure chamber 212, the inlet check valve 208 may not be held fully closed and may allow fuel to flow into fuel passage 154 towards lift pump 130 from pressure chamber 212. Accordingly, it may be desirable to use solenoid current to hold SV 202 closed past TDC when fuel vapor is detected at the inlet of the direct fuel injection pump, as will be described in reference to FIG. 3*b* below. In this way, inlet check valve 208 may be guaranteed to be closed throughout the delivery stroke. The angular duration of hold (closed) past TDC may be based on an uncertainty in angular position. For example, if the uncertainty of angular position is 5 degrees, then the SV may be held closed for 5 degrees after TDC to avoid unintentional opening of the inlet check valve, which is at greater risk when attempting to minimize pump inlet pressure in an effort to minimize lift pump electrical power.

Energizing and de-energizing solenoids 206 of spill valve 202 may be controlled by controller 170 based on the angular position of cam 146 received via connection 185. In other words, SV 202 may be controlled (i.e., activated and deactivated) in synchronization with the angular position of cam 146. The angular position of cam 146 may correspond to the linear position of pump piston 144, that is, when piston 144 is at TDC or BDC or any other position in between. In this way, the applied voltage (i.e., energizing) to SV 202 allowing SV 202 to open or close inlet may occur between BDC and TDC of pump piston 144.

Turning now to FIG. 3*b*, it illustrates a second control strategy for SV 202, and DI pump 140. Specifically, the second control strategy may be utilized when fuel vapor is detected at the inlet of DI pump 140 and/or when fuel vapor is at least partially ingested by DI pump 140. As explained earlier, ingestion of fuel vapor and/or the presence of fuel vapor at the inlet of the DI pump may adversely affect pressure increase within compression chamber 212. One method of detecting fuel vaporization may be based upon fuel capacitance readings from fuel composition sensor 148. In another example, fuel vapor may be detected by comparing a desired fuel pumping amount (that is, a commanded fuel amount) with an actual fuel amount pumped. Said another way, presence of fuel vapor may be detected based on a pump volumetric efficiency. The actual fuel amount pumped may be based on a fuel rail pressure change and a fuel injection amount over a period. In the second control strategy, the solenoid actuated spill valve is not de-energized prior to TDC but held energized past TDC.

FIG. 3*b* depicts second control strategy 304 which shows the operation of DI pump 140 during intake and delivery (or compression) strokes when fuel vapor is indicated by fuel composition sensor 148. FIG. 3*b* shows the same illustrated moments as FIG. 3*a*, particularly moments 310, 320, and 330 indicating events or changes in the operating state of DI pump 140. However, moment 345 is depicted at a different point in the operating cycle of the DI pump. Dashed arrows within the illustrated moments indicate fuel flow. Similar to FIG. 3*a*, signal timing chart 306 shows pump position 350, SV applied voltage signal 360 for controlling fuel intake into the DI pump 140, and solenoid current 370 resulting from the applied voltage signal 360. Time is plotted along x-axis wherein time increases from left to right of the x-axis. Signals and moments similar to FIG. 3*a* retain the same numbering as that described in FIG. 3*a*. It will also be noted that the operation cycle of DI pump 140 in the second control strategy 304 from time A until time C is the same as in first control strategy 300 of FIG. 3*a*. Accordingly, description for FIG. 3*b* from time A until time C is the same as that in FIG. 3*a* and will not be repeated in full here.

Briefly, solenoids 206 in SV 202 may be de-energized between time A and time S1 allowing fuel to flow into compression chamber 212 during the intake stroke (between time A and time B) and also permitting fuel flow out of compression chamber during a portion of the compression stroke (between time B and time S1). In preparation for fuel delivery, pull-in impulse 362 of the SV applied voltage 360 is initiated at time S1, as in FIG. 3*a*, to close SV 202 (as in, allow inlet check valve 208 to function as a check valve). In response to the pull-in impulse 362, the solenoid current 370 begins to increase. Thus, SV 202 may be energized at time S1.

At time C (and as shown in moment 330), SV 202 may continue to be energized and may now be fully closed in response to the SV applied voltage pull-in impulse and the increasing solenoid current 370. Accordingly, inlet check valve 208 now functions as a check valve to block fuel flow out of pressure chamber 212 towards fuel passage 154. It will be noted that time C occurs about midway during the compression stroke and in the depicted example, about 50% of fuel may be trapped within the pump to be pressurized and delivered to fuel rail 158. Furthermore, at time C, outlet valve 216 is opened, allowing for fuel flow from the pressure chamber 212 into fuel rail 158. After time C, the SV pull-in applied voltage 360 may be set to a holding signal 366 of approximately 25% duty cycle to command a holding solenoid current 370 in order to maintain the inlet check valve 208 in the closed position during fuel delivery.

In the depicted example of the second control strategy in response to detection of fuel vapor at the inlet of the DI pump, holding current duty cycle may end past TDC position of the piston. As shown in FIG. 3*b*, pump piston 144 attains TDC at time D, and the holding signal 366 may be ended at time A2 which occurs after time D. Thus, SV applied voltage is reduced to ground (GND) at time A2 consequently lowering the solenoid current 370, and de-energizing solenoids 206 of SV 202. Thus, SV 202 may be energized from time S1 until time A2. In one example, time A2 (when solenoids 206 are de-energized) may occur about 5 angular degrees of rotation after TDC (or time D). In another example, solenoids 206 may be de-energized about 5 angular degrees after pump piston 144 attains TDC position. Thus, SV 202 may be energized for a pre-determined angular duration past TDC. Since the controller may not accurately predict when TDC position of the pump piston occurs, the minimum angular duration energizing may reduce a likelihood of SV 202 closing before TDC. The solenoid actuated spill valve, SV 202, may thus be energized for a minimum angular duration based on the position of the pump piston. Herein, SV 202 may be energized based on pump piston position as follows: about 5 degrees before TDC and about 5 degrees after TDC. By maintaining the solenoids 206 energized past TDC, the inlet check valve 208 may be maintained closed even if fuel vapor is detected at the inlet of and/or fuel vapor is ingested by DI pump 140. Thus, the second control strategy may not rely on compression pressure within pressure chamber 212 to keep inlet check valve 208 in its closed position during the delivery stroke. It will be appreciated that the second control strategy may be executed only when fuel vapor is detected at the DI pump and may ensure that DI pump operation remains effective. The first control strategy may enable a reduction in power consumption and solenoid heating but the second control strategy may not provide these benefits. However, the second control strategy may be operative for shorter durations until fuel vapor formation conditions subside.

Upon completion of the compression stroke at time D, and after de-energizing solenoids 206 of SV 202 at A2, inlet check valve 208 may open as pressure within pressure chamber 212 decreases during the intake stroke in DI pump 140. Accordingly, fuel may flow into pressure chamber 212 from fuel passage 154. Further, outlet valve 216 may be closed when pump piston 144 attains the TDC position at time D.

Thus, the inventors herein have proposed that during fuel vapor ingestion or when fuel vapor is present, instead of commanding deactivation of SV 202 prior to the TDC position, according to first control strategy 300 of FIG. 3*a*, SV 202 may be commanded to remain energized or "on" for a minimum angle past TDC. In other words, only when fuel vapor is present and/or partially ingested by the DI pump, the solenoid spill valve is energized for a minimum angular duration that may extend beyond the TDC position, thereby energizing SV 202 past TDC, as shown by second control strategy 304 in FIG. 3*b*. Conversely, when fuel vapor is not present, the spill valve may be energized for a shorter duration for the same commanded trapping volume, such that the spill valve is de-energized before TDC position as shown by the first control strategy 300 of FIG. 3*a*. The angular duration refers to the time for cam 146 to rotate to a position that corresponds to a number of degrees, such as 15 or 25 degrees. In this way, DI pump 140 can be controlled according to first control strategy 300 when fuel vapor is not detected at the inlet of DI pump 140, and by second control strategy 304 when fuel vapor is detected at the inlet of the DI pump.

Thus, an example method may comprise energizing a solenoid spill valve of a direct injection fuel pump for or longer than a minimum angular duration based on a position of a piston in the direct injection fuel pump in response to fuel vapor detected at an inlet of the direct injection fuel pump. Fuel vapor may be detected based on fuel capacitance, wherein the fuel capacitance is measured via a fuel composition sensor positioned downstream of a lift pump and upstream of the direct injection fuel pump, the lift pump supplying fuel to the direct injection fuel pump. The solenoid spill valve may be maintained energized until after a top-dead-center (TDC) position of the piston is reached. Energizing the solenoid spill valve may include sending signals to the solenoid spill valve from a controller, wherein the controller further detects angular position of a driving cam that powers the direct injection fuel pump in order to synchronize energizing the solenoid spill valve. The method may further comprise when fuel vapor is not detected at the inlet of the direct injection fuel pump, energizing the solenoid spill valve for only an angular duration based on the position of the piston of the direct injection fuel pump. Herein, a minimum angular duration may not be utilized. Further, the solenoid spill valve may be maintained energized until a top-dead-center position of the piston is reached. In another example, the solenoid spill valve may be maintained energized until before the top-dead-center position of the piston is reached.

Turning now to FIG. 4, it presents an example method 400 for selecting and implementing one of the two control strategies described in FIGS. 3*a* and 3*b*. Specifically, the control strategy of the DI pump may be selected based on the presence of fuel vapor at the inlet of the DI pump.

At 402, engine operating conditions may be determined. The operating conditions include, for example, engine speed, fuel capacitance, engine load, air-fuel ratio, fuel rail pressure, driver demanded torque, and engine temperature. The operating conditions may be useful for operating the fuel system and ensuring efficient operation of the lift and DI pumps. Upon determining the operating conditions, at 404 method 400 may monitor fuel vapor formation. For example, an output from the fuel composition sensor, such as fuel composition sensor 148 of FIG. 1, may be monitored. The fuel composition sensor may signal changes in fuel capacitance to the controller, and a level of fuel vaporization may be determined based on the fuel capacitance. At 406, method 400 may determine if fuel vaporization is indicated. As such, presence of fuel vapor at the inlet of the DI pump may be confirmed. For example, as described above, the output of fuel composition sensor is based on fuel capacitance. Since fuel vapor has a lower dielectric value than liquid fuel, fuel vaporization may be detected. In one example, fuel vaporization may be indicated if the fuel capacitance falls within a predetermined range of the fuel capacitance of fuel vapor. In another example, fuel vapor may be detected by determining that the fuel pump actually pumped the fuel volume that it was commanded to pump. When actual fuel pumped is less than fuel commanded to be pumped, it may be inferred that fuel vapor is being ingested instead of liquid. In the absence of injection, a resulting fuel rail pressure rise may be utilized to compute actual fuel pumped. In the presence of injection, the actual fuel pumped may be based on a desired fuel amount entering the rail, an amount of fuel leaving the rail, and an amount of fuel stored/lost (based on fuel rail pressure (FRP) change, for example). If, at 406, it is determined that fuel vapor is present at the inlet of the DI pump, method 400 continues to 408 to operate the DI pump with the second control strategy 304 of FIG. 3*b*. Thus, the solenoid spill valve may be energized for a minimum angular duration such that it the solenoid spill valve remains energized past TDC position of the pump piston. Herein, the solenoid spill valve may be de-energized only after the pump piston attains TDC position.

On the other hand, if it is determined at 406 that fuel vapor is not present at the DI pump inlet, or that fuel vaporization is not indicated, method 400 proceeds to 410 to operate the DI pump with the first control strategy 300 of FIG. 3*a*. Herein, the solenoid spill valve may be commanded to de-energize before TDC position of the pump piston. In another example, the solenoid spill valve may be deactivated (de-energized) coincident with the TDC position of the pump piston. Accordingly, the solenoid spill valve may be energized for a shorter duration in the first control strategy relative to that in the second control strategy. As explained earlier, even though the solenoids in the solenoid actuated spill valve may be de-energized, the inlet check valve may be held closed due to compression pressure within the pressure chamber of the DI pump as the pump piston approached TDC.

In summary, the solenoid spill valve may be de-energized only past TDC for conditions when fuel vaporization is indicated by the fuel composition sensor. The solenoid spill valve may be de-energized at a minimum angular duration past TDC. It is noted that the controller may detect the angular position of the driving cam 146 in order to synchronize energizing the solenoid spill valve with the driving cam 146 and pump piston 144.

Thus, an example method may comprise during a first condition, de-energizing a solenoid spill valve of a direct injection fuel pump before a top-dead-center (TDC) position of a piston during a compression stroke in the direct injection fuel pump is reached, and during a second condition, de-energizing the solenoid spill valve only after the TDC position of the piston is reached. The first condition may include conditions when fuel vapor is not detected at an inlet of the direct injection fuel pump, and the second condition may include conditions when fuel vapor is detected at the inlet of the direct injection fuel pump. Fuel vapor may be detected by measuring fuel capacitance via a fuel composition sensor positioned downstream of a lift pump and upstream of the direct injection fuel pump. Further, de-energizing the solenoid spill valve may allow fuel to flow between a compression chamber of the direct injection fuel pump and a low pressure fuel line fluidically coupled to a lift pump, the lift pump positioned upstream of the direct injection fuel pump. Herein, when the solenoid spill valve is de-energized, fuel may flow from the compression chamber in the direct injection fuel pump towards the low pressure fuel line. Further still, de-energizing the solenoid spill valve may also allow fuel to flow from the low pressure fuel line to the compression chamber of the direct injection fuel pump.

Figure 5:
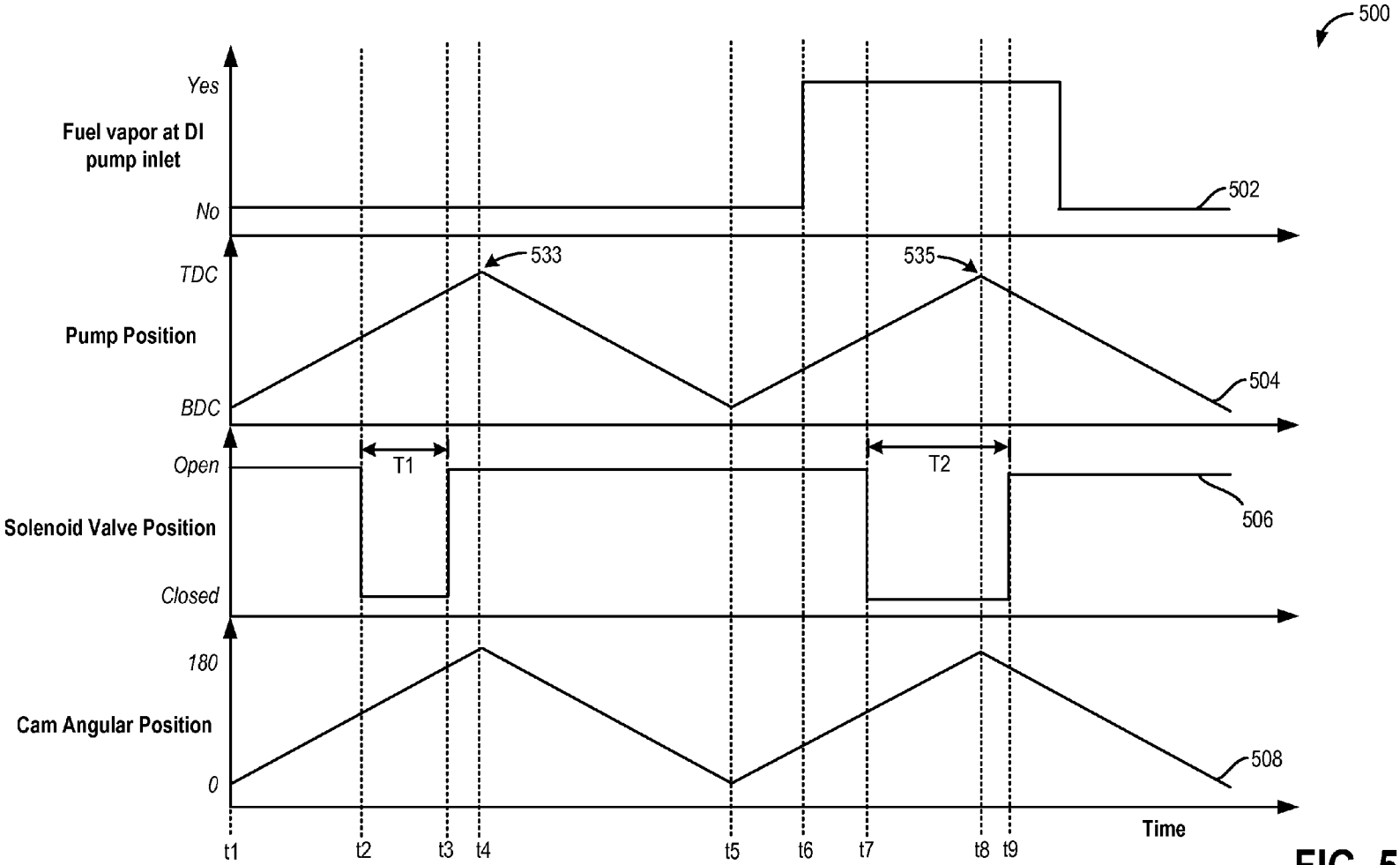
FIG. 5 demonstrates an example control of the solenoid actuated spill valve according to the present disclosure.

FIG. 5 shows an example chart 500 for operating the DI pump based on detection of fuel vapor according to an embodiment of the present disclosure. Time is plotted along the horizontal axis for chart 500 and time increases from the left to the right of the horizontal axis. Chart 500 depicts detection of fuel vapor (at the DI pump inlet) at plot 502, pump position at plot 504, a solenoid valve position at plot 506, and a cam angular position at plot 508. As mentioned earlier, fuel vaporization may be indicated by determination of fuel capacitance based on output from the fuel composition sensor (e.g. fuel composition sensor 148 of FIG. 1). Pump position may vary between the top-dead-center (TDC) and bottom-dead-center (BDC) positions of pump piston 144 as indicated by plot 504. For the sake of simplicity, instead of showing solenoid valve applied voltage and current, the solenoid valve position 506 is shown in FIG. 5 which may either be open or closed. The open position occurs when no voltage is applied to SV 202, and SV 202 is de-energized or deactivated. The closed position occurs when voltage is applied to SV 202, and SV 202 is energized or activated. While in reality the transitions from the open and closed positions occur over a finite time, that is, the time to switch between the open and closed positions of inlet check valve 208 via movement of plunger 204, the transitions are shown as occurring instantaneously in plot 506 of FIG. 5. Lastly, the cam angular position 508 varies from 0 degrees to 180 degrees, wherein 0 degrees corresponds to BDC and 180 corresponds to TDC. Since cam 146 continuously rotates, its position as measured by a sensor may oscillate between 0 and 180 degrees, where the cam 146 completes a full cycle every 360 degrees. It will be noted that a minimum angular duration may refer to the number of degrees of rotation of cam 146 (and the connected engine camshaft) upon which the activation (and deactivation) of SV 202 is based.

It will also be noted that in some examples, the full cycle of cam 146 may correspond to the full DI pump cycle consisting of the intake and delivery strokes, as shown in FIG. 5. Other ratios of cam cycles to DI pump cycles may be possible while remaining within the scope of the present disclosure. Furthermore, while the plots of pump position 504 and cam angular position 508 are shown as straight lines, these plots may exhibit more oscillatory behavior. For the sake of simplicity, straight lines are used in FIG. 5 while it is understood that other plot profiles are possible. Lastly, it is assumed that the engine and cam 146 are rotating at substantially constant speeds throughout the time shown since the slope of cam angular position 508 appears to remain substantially the same in FIG. 5.

At time t1, pump piston 144 may be at the BDC position (plot 504) according to a 0 degree position of cam 146 (plot 508). At this time, the solenoid valve 202 is de-energized and open to allow fuel to flow into and out of compression chamber 212. Further, as shown by plot 502, fuel vapor may not be detected at the inlet of the DI pump at t1. After time t1, a delivery stroke in the DI pump may commence, wherein between times t1 and t2 fuel is pushed by pump piston 144 backwards through solenoid spill valve 202 into low-pressure fuel passage 154 towards the lift pump 130. The time elapse between times t1 and t2 may correspond to fuel leaving pressure chamber 212 according to commanded (desired) trapping volume. At t2, solenoid spill valve 202 may be energized into the closed position, wherein fuel is substantially prevented from passing through inlet check valve 208. Between the energizing of solenoid spill valve 202 and TDC position indicated at 533, the remaining fuel (or trapped volume) in pressure chamber 212 is pressurized and sent through outlet valve 216. The amount of fuel pressurized between time t2 and TDC position 533 may be dependent on the commanded fractional trapping volume. In the example shown, solenoid spill valve 202 is energized to close about halfway through the compression stroke of the pump piston (halfway between BDC and TDC). Accordingly, the trapping volume commanded may be 50%. In other examples, trapping volume may be smaller (e.g. 15%). In yet other examples, commanded trapping volume may be higher (e.g. 75%).

Since no fuel vapor is detected between t1 and t3, the solenoid spill valve may be de-energized at t3, before TDC position 533 is attained at t4. Thus, input voltage to SV 202 may be ceased at t3 as depicted in first control strategy 300 of FIG. 3*a* and SV 202 may be de-energized at time t3. SV 202 may thus be energized for a time duration T1 corresponding to an angular duration of cam 146. As explained with respect to first control strategy 300 in FIG. 3*a*, the inlet check valve 208 of SV 202 may be maintained closed between t3 and t4 by the rising compression pressure within pressure chamber 212 even after solenoids 206 in SV 202 are de-energized.

Pump piston 144 attains TDC position at t4, and then withdraws from pressure chamber 212 to the BDC position as driven by cam 146 until the BDC position is reached at t5. Thereafter, another delivery stroke of DI pump 140 may commence at t5. At t6, fuel vapor may be detected at the inlet of DI pump 140. In response to the indication of fuel vapor, the controller may activate the second control strategy 304 of FIG. 3*b* for the DI pump. At t7, the solenoids in SV 202 may be energized to close SV 202 based on the commanded trapping volume (or duty cycle) of the DI pump. Similar to t2, solenoid spill valve is depicted as closing about halfway through the compression stroke in the DI pump enabling a trapping volume of about 50%. Since the second control strategy is activated due to the presence of fuel vapor, SV 202 may be held closed longer than the first control strategy 300 shown operating between t1 and t5. In other words, SV 202 remains energized past TDC position 535 which pump piston 144 reaches at t8. As shown, solenoid spill valve may be de-energized and opened at t9. In particular, voltage may be applied to SV 202 between times t7 and t9 for duration T2. SV 202 may be de-energized at a pre-determined minimum angular duration past TDC. In one example, the pre-determined minimum angular duration past TDC may be 10 crankshaft degrees (5 camshaft degrees).

It will be noted that time/angular durations T1 and T2 may be different for the same commanded trapping volume. As depicted, duration T1 is shorter than duration T2 for the same commanded trapping volume. In another example, based on the commanded trapping volume durations T1 and T2 may be the same. Furthermore, as previously mentioned, the DI pump cycle may consist of one intake stroke and one delivery stroke. Referring to FIG. 5, a delivery stroke occurs between t1 and TDC position 533 attained at t4 while another delivery stroke occurs between t5 and TDC position 535 attained at t8. An intake stroke occurs between TDC position 533 (reached at t4) and t5.

In some examples, SV 202 may be held energized for a time duration that is longer than T2 when fuel vapor is detected. For example, SV 202 may be de-energized after 15 camshaft degrees (of being energized) instead of 10 camshaft degrees. In other words, SV 202 may be de-energized at a time later than t9. The time duration T2 may be longer while not adversely affecting the intake of fuel during the following intake stroke of the pump. In other words, deactivation (or de-energizing) of the solenoid spill valve 202 after the TDC position is reached may not affect the fuel trapping volume fraction. In another example, the minimum angular duration may be 25 degrees. It will be appreciated that other angular durations of energizing SV 202 may be possible while remaining within the scope of the present disclosure.

Thus, the controller of the example system described earlier may include instructions stored in non-transitory memory for, during conditions when fuel vapor is detected at the inlet of the direct injection fuel pump, energizing the solenoid spill valve during a compression stroke, and de-energizing the solenoid spill valve only after the piston attains a top-dead-center (TDC) position in the direct injection fuel pump. The solenoid spill valve may be energized during the compression stroke in the direct injection fuel pump based on a duty cycle (or commanded trapping volume) of the direct injection fuel pump. Further, de-energizing the solenoid spill valve may allow fuel to flow between the compression chamber of the direct injection fuel pump and the low pressure fuel line fluidically coupled to the lift pump. Further still, energizing the solenoid spill valve may disable (or block) fuel flow between the low pressure fuel line and the direct injection fuel pump during the compression stroke. The controller may include further instructions for, during conditions when fuel vapor is not detected at the inlet of the direct injection fuel pump, de-energizing the solenoid spill valve coinciding with the TDC position of the piston during the compression stroke. The controller may also include further instructions for, during conditions when fuel vapor is not detected at the inlet of the direct injection fuel pump, de-energizing the solenoid spill valve before the piston attains the TDC position.

Figure 6:
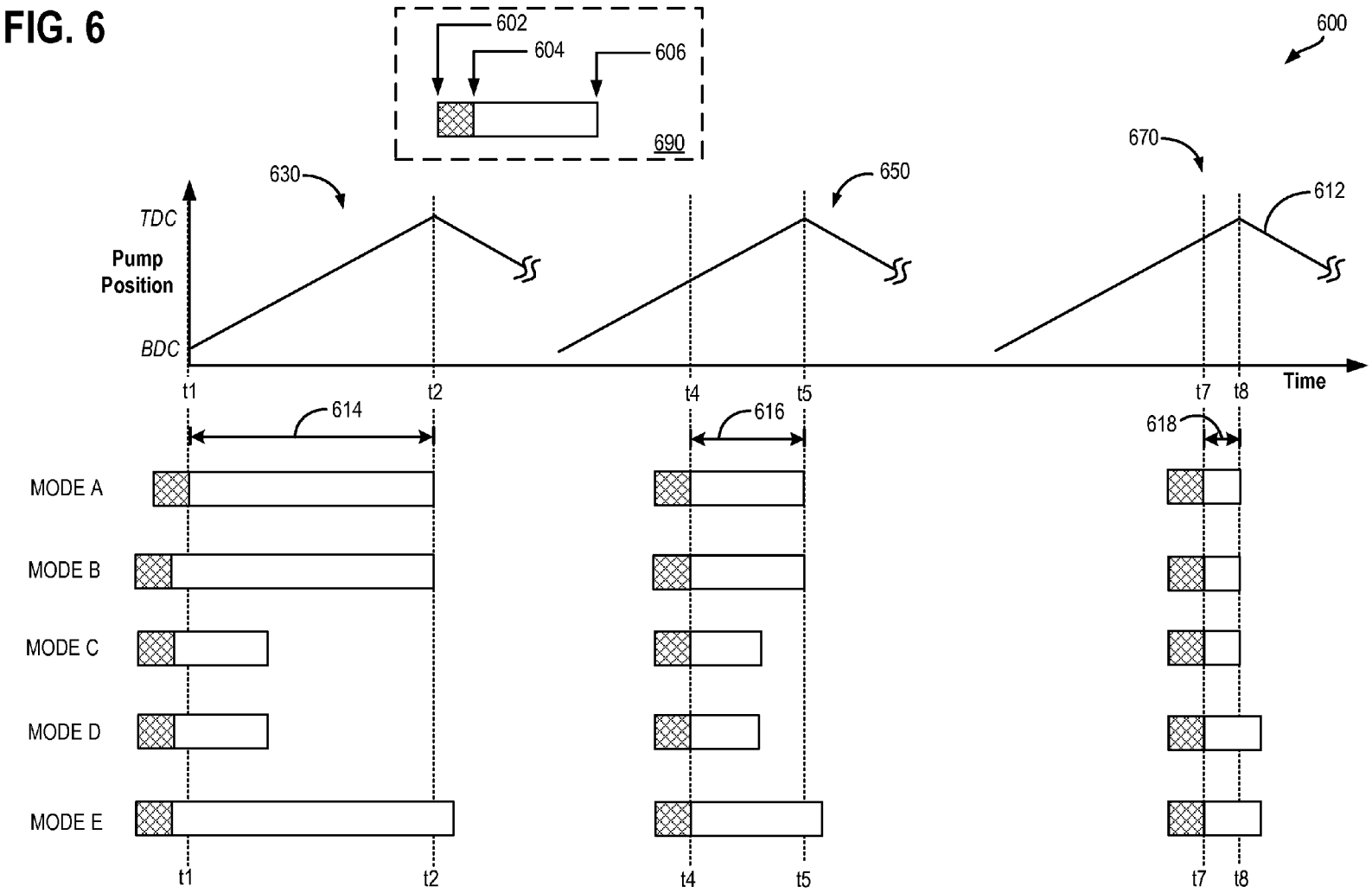
FIG. 6 shows different modes of control of the solenoid actuated spill valve in the direct injection fuel pump.

Turning now to FIG. 6, it depicts chart 600 indicating a variety of operating modes of the DI pump. Inset 690 depicts a schematic sketch of applying a voltage to the solenoid spill valve 202. At 602, a voltage may be applied to the solenoid spill valve, and at 604, the motion of the plunger 204 within solenoid spill valve 202 may be complete. A holding signal may be applied to the solenoid spill valve between 604 and 606, and at 606 the applied voltage may be removed.

Graphs 630, 650, and 670 indicate different duty cycles (or commanded trapping volume fractions) of the DI pump. Each of graphs 630, 650, and 670 depict pump position along the y-axis and time along the x-axis. Further, each of graphs 630, 650, and 670 present distinct examples of a delivery stroke in the DI pump. Graph 630 presents a 100% duty cycle wherein the solenoid spill valve is energized at t1, when the pump piston is at BDC, and held energized until t2, when the pump piston attains TDC, as indicated by 614. Accordingly, about 100% of the pump volume may be pressurized and delivered to the fuel rail and direct injector. Graph 650 portrays a 50% duty cycle wherein the solenoid spill valve is energized at t4, when the pump piston is about halfway between BDC and TDC, and held energized until t5, when the pump piston attains TDC, as indicated by 616. Herein, the commanded trapping volume may be 50% such that 50% of the fuel within the pressure chamber may be sent towards fuel injectors. Graph 670 illustrates a commanded 10% duty cycle wherein the solenoid spill valve is energized at about 90% through the delivery stroke such that about 10% fuel is delivered to the fuel rail (as indicated by 618). Graphs 630, 650, and 670 depict desired duty cycles which may be implemented in different modes to accomplish varied objectives. For example, the commanded duty cycle may be obtained by energizing the solenoid for an entire compression angle of the cam 146 as shown in mode A. Further, in mode A, for all commanded duty cycles, SV 202 may be de-energized coinciding with the pump piston attaining TDC position. For a 100% duty cycle, SV 202 may be energized at a time such that plunger 204 completes its motion by time t1 of graph 630 when pump piston is at BDC. In the example of 50% commanded trapping volume shown in graph 650, SV 202 may be energized such that inlet check valve 208 is closed about halfway through the compression stroke at t4 of graph 650. Lastly, as shown in graph 670, mode A may energize SV 202 such that plunger 204 completes its motion when about 10% of fuel volume exists in compression chamber of DI pump 140 at time t7. As such operating mode A may be utilized when an ideal pump behavior may be assumed.

Operating mode B may be utilized when a maximum fuel delivery may be desired in the presence of an angular error. In mode B, for 100% duty cycle, SV 202 may be energized prior to t1 and may remain energized such that check valve 208 is closed up to TDC. For 50% duty cycle and 10% duty cycle operation in mode B, SV 202 may be energized such that check valve 202 is closed up to TDC. Mode B differs from mode A only for the example of 100% commanded trapping volume. Herein, SV 202 may be energized such that inlet check valve 208 is closed prior to the pump piston attaining BDC position within an intake stroke for the 100% duty cycle, e.g. before time t1. The early closure may guarantee a complete 100% duty cycle and a full pump stroke that delivers the entire pump volume to the fuel rail. Solenoid spill valve control may remain the same as that in mode A for the remaining commanded volumes e.g., duty cycles other than 100% duty cycles. In case 630, mode B, C, D, and E may be used when maximum fuel delivery is desired. By activating the check valve early, even if there is some angular error, maximum possible pump volume may be attained. Further, in case 630, mode E may provide safety margin at both ends.

Operating mode C may be utilized when it may be possible to turn off the hold current prior to TDC (for example, when liquid is ingested and fuel vapor is below a threshold amount). In the example of mode C, the desired commanded trapping volume fraction may be obtained while reducing power consumption and solenoid heating. Herein, the solenoid spill valve (e.g. SV 202) may be de-energized before the pump piston reaches TDC position. Further, the inlet check valve 208 may be held closed by the pressure within pressure chamber 212. It will be noted that the solenoid spill valve may be de-energized at a different time in the stroke for a particular commanded trapped volume. To elaborate, the solenoid spill valve may be de-energized based on a fraction of completion of the compression stroke based on a pressure developed within the pressure chamber 212.

For example, SV 202 may be de-energized at an earlier time in the compression stroke when 100% trapping volume is commanded relative to when a 50% trapping volume is commanded. As depicted, SV 202 is closed when about one-third of the delivery stroke is completed when the commanded trapping volume is 100%. On the other hand, when the commanded duty cycle is 50%, SV 202 is closed when about three-fourth (75%) of the delivery stroke is complete. When a 10% trapping volume is commanded, SV 202 may be de-energized coinciding with the time when TDC position is attained or just before TDC is reached. It will be noted that mode C is similar to mode B in that only for a 100% duty cycle, SV 202 may be energized such that inlet check valve 208 is closed prior to the pump piston attaining BDC position within an intake stroke for the 100% duty cycle.

Operating mode D may be utilized when an angular error may be present and when maximum fuel delivery is desired. Mode D is similar to mode C except for the example of smaller commanded trapping volumes, e.g. graph 670. Herein, when commanded trapping volumes are smaller than a threshold, e.g. 15% volume, the solenoid spill valve may be held energized until past TDC. Graph 670 depicts an example wherein the commanded trapped volume is about 10%, less than the threshold of 15%. Accordingly, in mode D, SV 202 is energized to allow 10% fuel to be trapped but may be de-energized only after the pump piston reaches TDC position. Therefore, SV 202 is de-energized only after time t8 when pump piston attains TDC in graph 670. For other commanded trapping volumes, mode D is similar to mode C.

Operating mode E depicts the example described in the present disclosure and is utilized only when fuel vapor is detected at the inlet of the DI pump. SV 202 may be energized such that check valve 208 is holding (closed) past TDC to always prevent any possibility of early inlet check valve release. This extra action is appropriate for vapor ingestion where the compression chamber pressure may be insufficient to hold the inlet valve closed via pressure. Specifically, in mode E, for each commanded duty cycle, SV 202 is maintained energized until past TDC position of the pump piston during a delivery stroke. Accordingly, in graph 630, SV 202 is de-energized past time t2, in graph 650, SV 202 is de-energized past time t5, and in graph 670, SV 202 is de-energized past time t8.

In this way, DI pump operation may be accomplished effectively for conditions of fuel vapor formation at the inlet of the DI pump. By maintaining the solenoid spill valve energized and closed past a top-dead-center position of a compression stroke in the DI pump, reliance on fuel compression pressure to maintain an inlet check valve of the DI pump closed may be reduced. As such, the DI pump may develop a desired fuel pressure even with fuel vaporization. Overall, DI pump operation may be more reliable and efficient.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

energizing a solenoid spill valve of a direct injection fuel pump for an angle past top center of a piston in the direct injection fuel pump in response to fuel vapor detected at an inlet of the direct injection fuel pump.

2. The method of claim 1, wherein fuel vapor is detected based on fuel capacitance.

3. The method of claim 2, wherein the fuel capacitance is measured via a fuel composition sensor positioned downstream of a lift pump and upstream of the direct injection fuel pump, the lift pump supplying fuel to the direct injection fuel pump.

4. The method of claim 1, wherein the fuel vapor is detected based on a difference between a commanded fuel amount and an actual fuel amount pumped; and wherein the actual fuel amount pumped is based on a FRP change and a fuel injection amount over a period.

5. The method of claim 1, wherein the solenoid spill valve is maintained energized until after a top-dead-center position of the piston is reached.

6. The method of claim 1, wherein energizing the solenoid spill valve includes sending signals to the solenoid spill valve from a controller.

7. The method of claim 6, wherein the controller further detects angular position of a driving cam that powers the direct injection fuel pump in order to synchronize energizing the solenoid spill valve.

8. The method of claim 1, further comprising, when fuel vapor is not detected at the inlet of the direct injection fuel pump, energizing the solenoid spill valve for only an angular duration based on the position of the piston of the direct injection fuel pump.

9. The method of claim 8, wherein the solenoid spill valve is maintained energized until a top-dead-center position of the piston is reached.

10. A method, comprising:

during a first condition, de-energizing a solenoid spill valve of a direct injection fuel pump before a top-dead-center (TDC) position of a piston during a compression stroke in the direct injection fuel pump is reached; and during a second condition, de-energizing the solenoid spill valve only after a non-zero angular rotation after the TDC position of the piston is reached.

11. The method of claim 10, wherein the first condition includes conditions when fuel vapor is not detected at an inlet of the direct injection fuel pump, and wherein the second condition includes conditions when fuel vapor is detected at the inlet of the direct injection fuel pump.

12. The method of claim 11, wherein fuel vapor is detected by measuring fuel capacitance via a fuel composition sensor positioned downstream of a lift pump and upstream of the direct injection fuel pump.

13. The method of claim 10, wherein de-energizing the solenoid spill valve allows fuel to flow between a compression chamber of the direct injection fuel pump and a low pressure fuel line fluidically coupled to a lift pump, the lift pump positioned upstream of the direct injection fuel pump.

14. A system, comprising:

an engine including a cylinder;

a direct fuel injector coupled to the cylinder;

a direct injection fuel pump including a piston, a compression chamber, and a cam for driving the piston;

a high pressure fuel rail fluidically coupled to each of the direct fuel injector and an outlet of the direct injection fuel pump;

a solenoid spill valve fluidically coupled to an inlet of the direct injection fuel pump;

a lift pump fluidically coupled to the solenoid spill valve via a low pressure fuel line;

a fuel composition sensor coupled to the low pressure fuel line downstream of the lift pump and upstream of the solenoid spill valve; and a controller with computer readable instructions stored in non-transitory memory for:

during conditions when fuel vapor is detected at the inlet of the direct injection fuel pump, energizing the solenoid spill valve during a compression stroke; and de-energizing the solenoid spill valve only after the piston attains a top-dead-center (TDC) position in the direct injection fuel pump.

15. The system of claim 14, wherein fuel vapor is detected based on fuel capacitance, the fuel capacitance measured by the fuel composition sensor.

16. The system of claim 14, wherein the solenoid spill valve is energized during the compression stroke in the direct injection fuel pump based on a duty cycle of the direct injection fuel pump.

17. The system of claim 14, wherein de-energizing the solenoid spill valve allows fuel to flow between the compression chamber of the direct injection fuel pump and the low pressure fuel line fluidically coupled to the lift pump.

18. The system of claim 17, wherein energizing the solenoid spill valve disables fuel flow between the low pressure fuel line and the direct injection fuel pump during the compression stroke.

19. The system of claim 18, wherein the controller comprises further instructions for, during conditions when fuel vapor is not detected at the inlet of the direct injection fuel pump, de-energizing the solenoid spill valve coinciding with the TDC position of the piston during the compression stroke.

20. The system of claim 18, wherein the controller comprises further instructions for, during conditions when fuel vapor is not detected at the inlet of the direct injection fuel pump, de-energizing the solenoid spill valve before the piston attains the TDC position.

* * * * *